US005653822A

United States Patent [19]

Stickels et al.

[11] Patent Number: 5,653,822

[45] Date of Patent: Aug. 5, 1997

[54] COATING METHOD OF GAS CARBURIZING HIGHLY ALLOYED STEELS

[75] Inventors: Charles Arthur Stickels, Ann Arbor; Claude Melvin Mack, Ypsilanti; Gary Wayne Hagler, Howell; Eugene Joseph Cabadas, Fenton, all of Mich.

[73] Assignee: Ford Motor Company, Dearborn, Mich.

[21] Appl. No.: 498,161

[22] Filed: Jul. 5, 1995

[51] Int. Cl.[6] ..... C23C 8/22

[52] U.S. Cl. ..... 148/220; 148/217

[58] Field of Search ..... 148/217, 225, 148/537, 317, 220

[56] References Cited

U.S. PATENT DOCUMENTS

| | | | |
|---|---|---|---|
| 2,758,950 | 8/1956 | Lakner | 148/19 |
| 3,313,660 | 4/1967 | Vordahl | 148/11.5 |
| 3,344,817 | 10/1967 | Connard | 148/12.1 |
| 3,661,656 | 5/1972 | Jarleborg | 148/12.1 |
| 3,827,923 | 8/1974 | Harvey et al. | 148/31.5 |
| 3,885,995 | 5/1975 | Cunningham et al. | 148/6.35 |
| 3,969,158 | 7/1976 | Holbert | 148/16.5 |
| 4,013,487 | 3/1977 | Ramqvist et al. | 148/16.5 |
| 4,157,258 | 6/1979 | Philip et al. | 75/124 |
| 4,622,081 | 11/1986 | Stickels et al. | 420/111 |
| 5,094,699 | 3/1992 | Feichtinger et al. | 148/225 |

FOREIGN PATENT DOCUMENTS

| | | | |
|---|---|---|---|
| 4929056 | 8/1974 | Japan | 148/217 |

OTHER PUBLICATIONS

Stickels, C.A., et al, "Heat Treatment of Some Temperature–Resistant Carburizing Steels", Journal of Heat Treating, vol. 4, No. 3, Jun., 1986, American Society For Metals, pp. 223–236.

Schmidt, Michael L., "Pre–oxidation Prior To Gas Carburizing: Theory and Its Effect on Pyrowear 53 Alloy", *Carburizing Processing and Performance,* 1989, G. Krauss, ed., ASM International, pp. 83–100.

Stickels, C.A., "Gas Carburizing", ASM Handbook, vol. 4, Heat Treating, 1991, pp. 312–324.

*Primary Examiner*—Deborah Yee

*Attorney, Agent, or Firm*—Joseph W. Malleck; Roger L. May

[57] ABSTRACT

A method of applying a surface coating to promote gas carburization of a highly alloyed steel. The method includes the step of coating the highly alloyed steel with a layer of iron or an iron alloy to form a coated steel before carburizing the coated steel in a conventional gas carburizing atmosphere.

10 Claims, 3 Drawing Sheets

COATING METHOD OF GAS CARBURIZING HIGHLY ALLOYED STEELS

TECHNICAL FIELD

This invention relates to a method of applying a surface coating to promote gas carburization of a highly alloyed steel.

BACKGROUND ART

Several high alloy carburizing steels (HACS) have been developed for bearings and gears which operate under extreme conditions of temperature or corrosive environment. HACS alloys include CBS 1000M and CBS 50NiL made by the Latrobe Steel Company (a subsidiary of the Timken Company), Pyrowear 53 and Pyrowear 675 made by Carpenter Technology Corp. and Vasco X-2M (Teledyne Vasco). Nominal compositions of these alloys are listed in Table I.

HACS alloys are also used in aerospace applications such as helicopter gearing, and in drill bits for deep well drilling. Because these alloys resist softening at elevated temperatures, they are also useful for machine components that operate in less extreme environments, but which may be inadequately lubricated.

Unfortunately, for reasons that are not well understood, HACS components cannot be gas carburized in the as-machined condition, although they can be pack carburized or plasma carburized. METALS HANDBOOK, vol. 4, Tenth Edition, ASM International, 1991. Gas carburizing, pack carburizing and plasma carburizing are described in articles on pages 312–24, 325–328 and 352–62, respectively.

Gas carburizing is the method of choice for high volume production. Virtually all carburization of automotive components worldwide is done by gas carburizing. In a conventional gas carburizing atmosphere, the oxygen content is too low to allow iron oxide to form, but there is enough oxygen in the furnace atmosphere that oxides of alloying elements such as Cr, Si, Mn and V can form. Apparently, it is the formation of these alloy oxides on the metal surface in a gas carburizing atmosphere which prevents adequate pick-up of carbon.

TABLE I

NOMINAL COMPOSITIONS OF HACS ALLOYS

| ELEMENT | CBS1000M | CBS50NIL | PYROWEAR 53 | PYROWEAR 675 | VASCO X-2M |
|---|---|---|---|---|---|
| Carbon | 0.13 | 0.13 | 0.11 | 0.07 | 0.14 |
| Manganese | 0.55 | 0.25 | 0.35 | 0.65 | 0.30 |
| Silicon | 0.50 | 0.20 | 0.80 | 0.40 | 0.90 |
| Chromium | 1.05 | 4.20 | 1.00 | 13.00 | 5.00 |
| Nickel | 3.00 | 3.40 | 2.25 | 2.60 | |
| Cobalt | | | | 5.40 | |
| Molybdenum | 4.50 | 4.25 | 3.25 | 0.80 | 1.40 |
| Vanadium | 0.40 | 1.20 | 0.10 | 1.60 | 0.45 |
| Copper | | | 2.10 | | |
| Tungsten | | | | | 1.35 |

U.S. Pat. No. 3,885,995 discloses that if components made of HACS alloys are heated in air at temperatures on the order of 900°–1000° C. for times of 30 minutes or more prior to gas carburizing, then the alloys will carburize satisfactorily. Typically, exposure to air at these temperatures forms a loosely adherent oxide layer (primarily FeO) over a mixed metal-oxide sublayer a few microns in thickness. The sublayer consists of fingers of oxide penetrating into the metal matrix. Metal is lost from the surface of parts and the surface is roughened during the preoxidation treatment. Therefore, parts which are preoxidized prior to carburization must be finish-machined in the hardened condition after heat treatment to achieve a smooth surface and precise control of dimensions.

SUMMARY OF THE INVENTION

Disclosed is a method of applying a surface coating to promote gas carburization of a highly alloyed steel in an as-machined condition.

The method calls for the step of coating the highly alloyed steel with a layer of iron for carburizing the coated steel in conventional gas carburizing equipment.

Thus, in the present invention, an alternative to preoxidation as a means for enhancing gas carburizing is described.

The above objects and other objects, features, and advantages of the present invention are readily apparent from the following detailed description of the best mode for carrying out the invention when taken in connection with the accompanying drawings.

DETAILED DESCRIPTION OF THE PREFERRED EMBODIMENTS

Broadly stated, the present invention discloses a method of applying a surface coating to promote gas carburization of a highly alloyed steel in an as-machined condition. The method comprises the steps of coating the highly alloyed steel with a layer of iron to form a coated steel. Then, the coated steel is carburized in conventional gas carburizing equipment.

It has been found that if HACS samples are coated with a layer of iron on the order of 10 microns (0.01 mm or 0.0004") in thickness, then carburizing can be carried out satisfactorily in conventional gas carburizing equipment. Without wishing to be bound by any particular theory, it would appear that during the course of a carburizing treatment diffusion occurs at the interface between the iron coating and the HACS substrate, making the coating integral with the substrate.

With this technology, it will be possible to use components as-heat-treated for many applications, i.e., surface smoothing following heat treatment will not be required. This is advantageous because a) finishing of hardened surfaces is costly, and b) there is a possibility that surfaces will be damaged (and durability reduced) if excessive heat is generated at the surface during the finishing operation.

Several sets of experiments were run to demonstrate the efficacy of iron coatings. Samples of alloy CBS 50NiL were electroplated to produce iron coatings ranging in thickness from about 2 to about 9 microns. The coating thickness was computed from the weight gained during plating, the density of iron and the surface area of the specimen. Along with as-machined and pre-oxidized specimens, the samples were gas carburized in separate runs of 1.5, 3 and 6 hours at 955° C. (1750° F.) using a carbon potential of 1%. The furnace atmosphere consisted of endothermic gas (produced by reacting natural gas and air) plus an addition of natural gas. The amount of natural gas added was automatically regulated to maintain a constant voltage on an oxygen sensor inserted into the furnace chamber.

Figure 1:
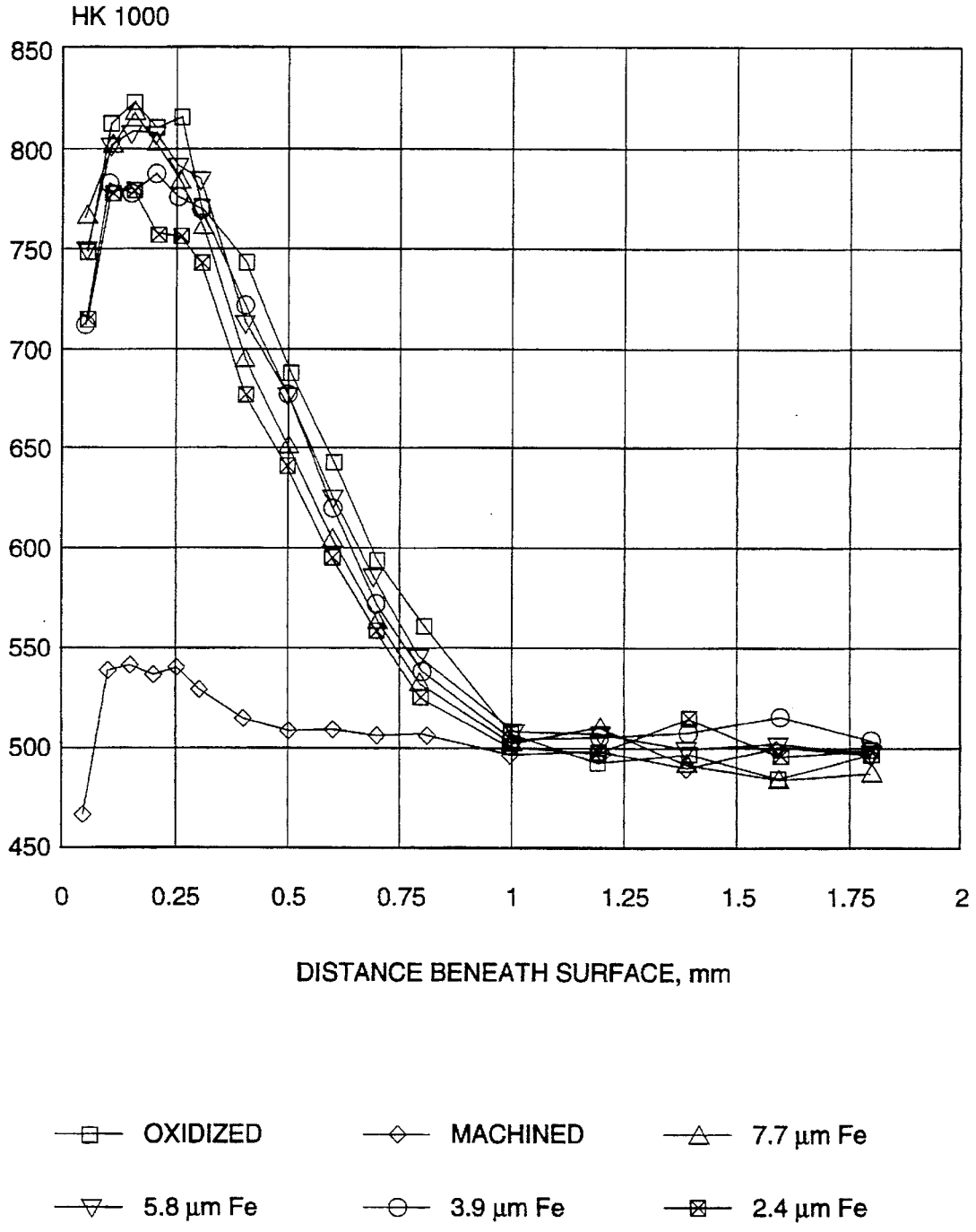
FIGS. 1–3 summarize the results of experiments run to demonstrate the efficacy of iron coatings to promote gas carburization of a highly alloyed steel.
Figure 2:
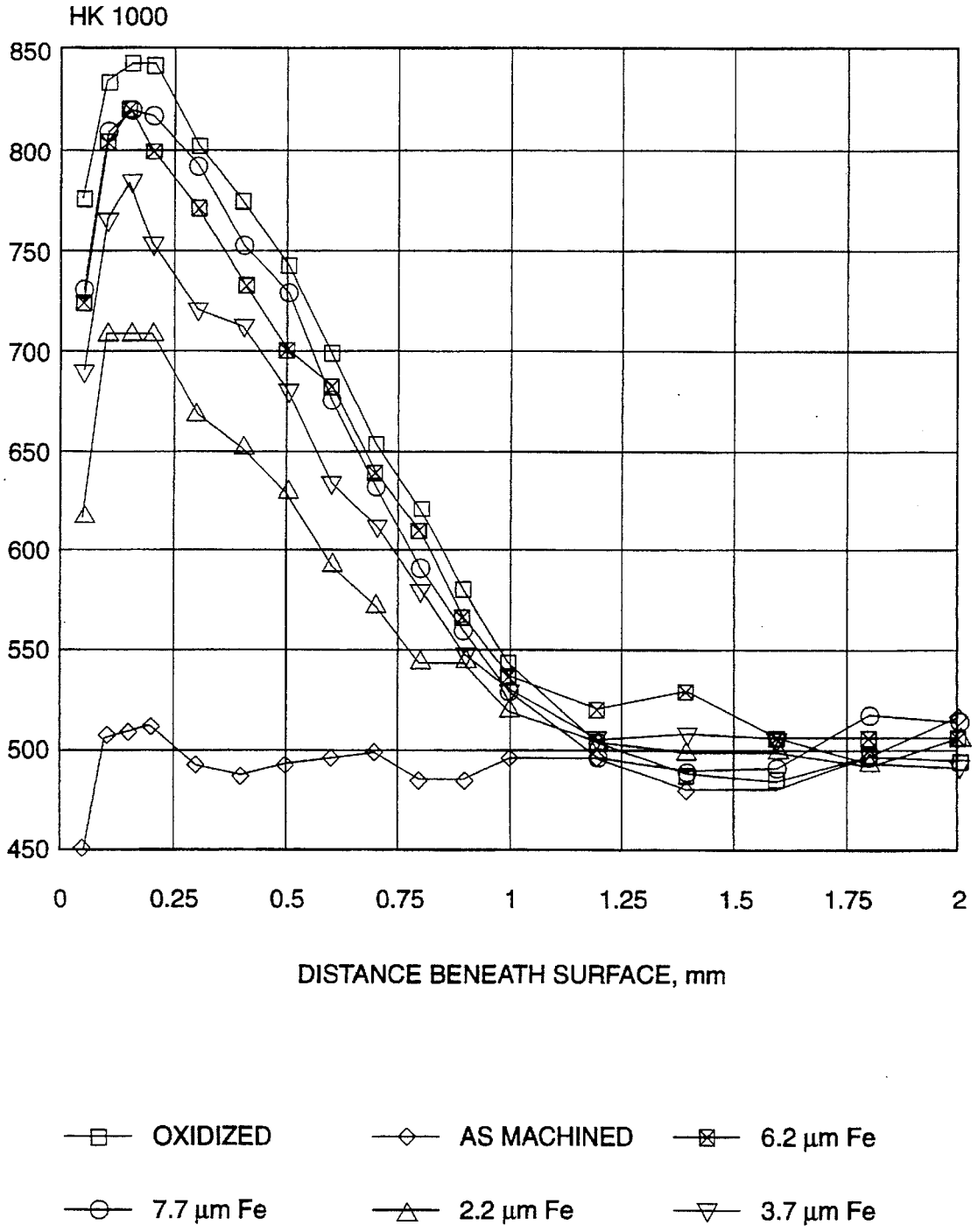
Figure 3:
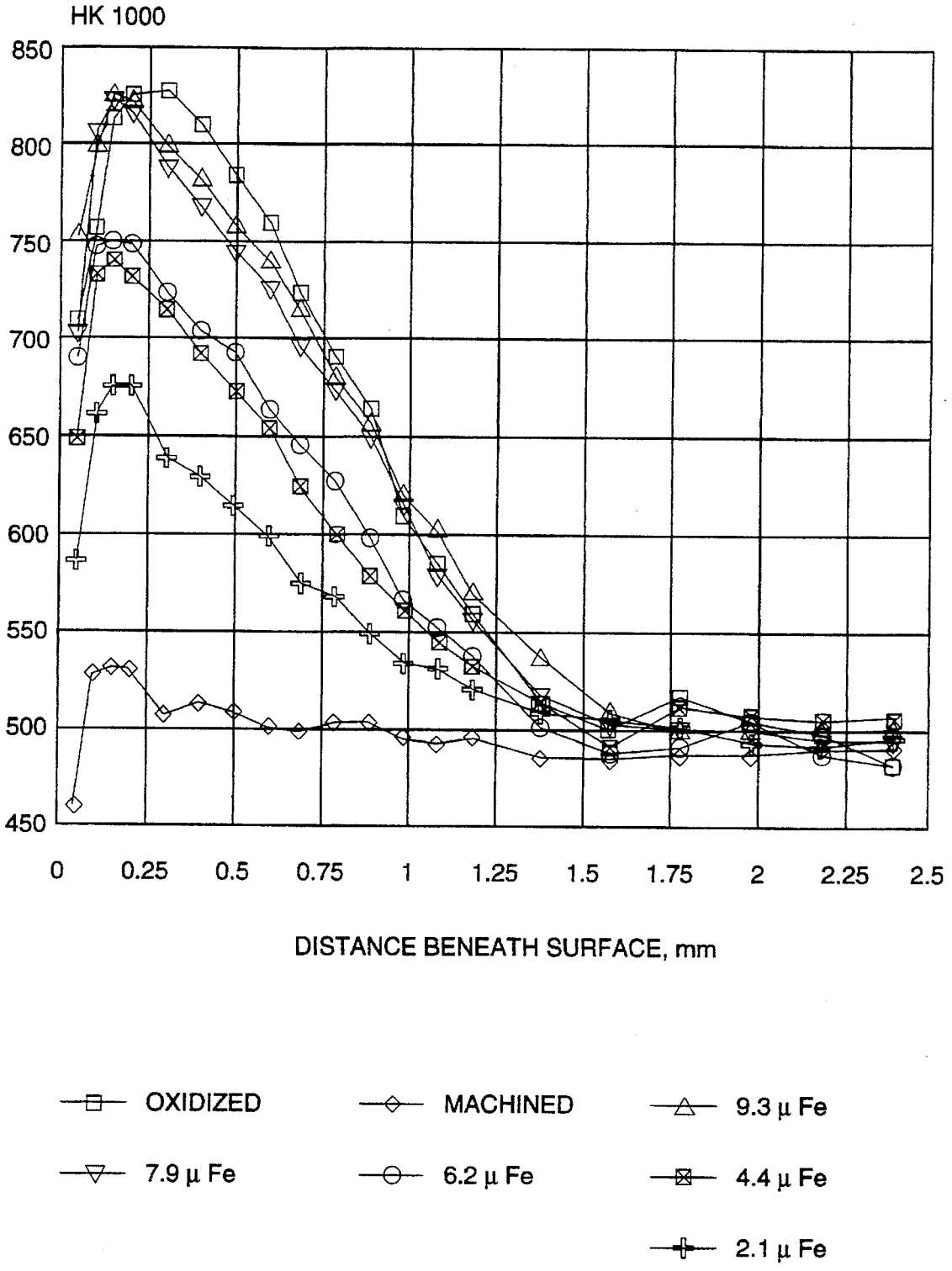

After the samples were charged into the furnace vestibule, the vestibule was purged for at least 1.5 hours to minimize the amount of air charged into the furnace chamber with the load. After carburizing, samples were sealed in a metal envelope, heated to 1120° C. (2050° F.) for 15 minutes, quenched into water (while still in the envelope), then placed in liquid nitrogen for 30 minutes. Specimens were tempered at 525° C. (975° F.) for 2 hours, cooled to room temperature, then tempered for another 2 hours at the same temperature. Metallographic specimens were prepared of each heat treated sample and Knoop microhardness (1000 gram load) was measured as a function of distance from the carburized surface. FIGS. 1–3 summarize the results of the experiments.

When the carburizing time was 1.5 hours (FIG. 1), the preoxidized sample and all of the iron plated samples became case hardened. The amount of carbon picked up by the uncoated, as-machined sample was very low, so it did not case harden appreciably.

When the carburizing time was increased to 3 hours (FIG. 2), samples with iron coatings of 3.7 microns or less did not case harden to the same degree as the preoxidized sample or the samples with iron coatings of 6.2 and 7.7 microns. As before, case hardening of the uncoated, as-machined sample was negligible.

Finally, after 6 hours carburizing (FIG. 3), it was found that the case hardening of samples with iron coatings of 6.2 microns or less was reduced appreciably when compared with samples with coatings of 7.9 microns or more.

In summary, it was found that in order to achieve maximum case hardening, the minimum thickness of the iron coating necessary becomes greater as the carburizing time becomes longer. Similar results have been obtained when the iron coating was applied by sputtering.

FIGS. 1–3 show that samples coated with an iron layer which is 10 microns in thickness will carburize satisfactorily for total case depths of 1.6 mm or less (FIG. 3). A longer carburizing time and/or a higher carburizing temperature is required to produce deeper cases. For such treatments, a thicker iron coating is required.

It is possible that coatings of iron alloys (produced by sputtering, plating, or some other means) would facilitate carburizing as well or better than unalloyed iron coatings, e.g., a Fe coating alloyed with Mo. However, certain coatings do not work. In one experiment, a nickel-plated specimen failed to carburize appreciably while a pre-oxidized sample carburized satisfactorily.

In preliminary experiments it was found that high integrity iron coatings were obtained when samples were degreased, pickled in acid, and then electroplated in a freshly prepared ferrous sulfate bath. Preferably, the highly alloyed steel in CBS 50NiL, which was among the most highly alloyed and most difficult to carburize of the alloys cited. In order to prove the efficacy of iron coatings it was necessary to ensure that samples were not unintentionally preoxidized by air remaining in the furnace vestibule while being heated to the carburizing temperature. Accordingly, in one example, a carburizing furnace vestibule with a volume of approximately 40 cubic feet was purged for 1.5 hours with an endogas flow of 125 cubic feet per hour. By calculation, it was estimated that a purge of this duration removed at least 99% of the air that entered the vestibule with the load. All the data reported in FIGS. 1–3 were obtained using a minimum purge time of 1.5 hours and an endogas flow of 125 cubic feet per hour.

It has also been found that variations in tempering temperature lead to variability in the peak hardness obtained after carburizing. While a tempering temperature of 960°–975° F. is acceptable, 990° F., for example, is too high and will reduce the case hardness.

Thus, it has been found that for adequate case depth and case hardness, the coating thickness required varies with the carburizing time. As little as 2 microns of iron are sufficient for 1.5 hours, about 6 microns is enough for 3 hours, and about 8 microns is needed for 6 hours.

The experiments also show that iron coatings on the order of 10 microns or less in thickness enable high alloy steels to be gas carburized for effective case depths up to 1.25 millimeters. Deeper cases require thicker coatings.

The inventors have considered whether samples need to be coated and why a separate pre-oxidation treatment is desirable if the samples can be pre-oxidized and carburized all at once if some air is left in the vestibule. In the applicants' experience, the amount of carburizing is usually less. Additionally, the carburizing results are not reproducible if one relies solely upon air left in the vestibule.

Thus, the inventors have disclosed a method of applying a surface coating to promote gas carburization of a highly alloyed steel which has the characteristics of enhanced resistance to hardness degradation under high temperatures and/or enhanced resistance to sliding wear and contact fatigue under conditions of poor lubrication.

While the best mode for carrying out the invention has been described in detail, those familiar with the art to which this invention relates will recognize various alternative designs and embodiments for practicing the invention as defined by the following claims.

What is claimed is:

1. A method of applying a surface coating to promote gas carburization of a non-planar specimen of a highly alloyed steel, comprising:

coating the non-planar specimen of a highly alloyed steel with a layer of iron to form a coated steel; and carburizing the coated steel in conventional gas carburizing equipment.

2. The method of claim 1 wherein the step of coating the highly alloyed steel to form a coated steel comprises the step of coating the highly alloyed steel with a layer of iron having a thickness of about 10 microns.

3. A method of applying a surface coating to promote gas carburization of a non-planar specimen of a highly alloyed steel, comprising:

coating the non-planar specimen of the highly alloyed steel with a layer of iron to form a coated steel; and carburizing the coated steel in conventional gas carburizing equipment;

wherein the highly alloyed steel is selected from the group consisting of CBS 50NIL, CBS 1000M, Pyrowear 53, Pyrowear 675, and Vasco X-2M.

4. The method of claim 1 wherein the coating step comprises an electroplating operation.

5. The method of claim 4 wherein the coating step further comprises preparing a layer of iron having a thickness from about 2 to about 9 microns.

6. The method of claim 1 wherein the coating step comprises a sputtering operation.

7. A method of applying a surface coating to promote gas carburization of a non-planar specimen of the highly alloyed steel, comprising:

coating the non-planar specimen of the highly alloyed steel with a layer of an iron alloy to form a coated steel; and carburizing the coated steel in conventional gas carburizing equipment.

8. The method of claim 7 wherein the iron alloy consists essentially of iron alloyed with molybdenum.

9. A method of applying a surface coating to promote gas carburization of a highly alloyed steel, consisting essentially of:

coating the highly alloyed steel with a single layer of iron to form a coated steel; and carburizing the coated steel in conventional gas carburizing equipment.

10. The method of claim 1 wherein the step of coating the highly alloyed steel to form a coated steel comprises the step of coating the highly alloyed steel with a layer of iron, the thickness of which is selected so that the minimum thickness of the iron layer rises with carburizing time.

* * * * *